US005522285A

United States Patent [19]

Wilson, Jr. et al.

[11] Patent Number: 5,522,285

[45] Date of Patent: Jun. 4, 1996

[54] MECHANISM FOR LOCATING A SLOTTED SOCKET RELATIVE TO A DRIVE TRANSFER HOUSING AND COMBINATION THEREOF

[75] Inventors: David Wilson, Jr., 8022 Dry Creek Cir., Longmont, Colo. 80503; Bruce D. Steffen, Las Vegas, Nev.

[73] Assignee: David Wilson, Jr., Boulder, Colo.

[21] Appl. No.: 299,211

[22] Filed: Aug. 31, 1994

Related U.S. Application Data

[63] Continuation-in-part of Ser. No. 276,506, Jul. 18, 1994, Pat. No. 5,460,062, which is a continuation of Ser. No. 25,949, Mar. 3, 1993, abandoned.

[51] Int. Cl.[6] ..... B25B 21/00

[52] U.S. Cl. ..... 81/57.14; 81/57.3; 81/58.2

[58] Field of Search ..... 81/57.13, 57.14, 81/57.29, 57.3, 58.2

[56] References Cited

U.S. PATENT DOCUMENTS

| | | | |
|---|---|---|---|
| 1,648,134 | 11/1927 | Kientz . | |
| 2,537,175 | 1/1951 | Viets . | |
| 2,578,686 | 12/1951 | Fish . | |
| 2,630,731 | 3/1953 | Imboden . | |
| 3,257,877 | 6/1966 | Ulrich et al. | 81/57.14 X |
| 3,477,318 | 11/1969 | Batten . | |
| 3,535,960 | 10/1970 | Borries | 81/58.2 X |
| 3,602,071 | 8/1971 | Johasz | 81/57.14 |
| 3,620,105 | 11/1971 | Batten . | |
| 4,374,479 | 2/1983 | Minotti . | |
| 5,050,463 | 9/1991 | Stielow . | |

OTHER PUBLICATIONS

Drawings of a Device made and sold by Applicant more than one year before the filing date of the instant application (i.e., before Aug. 31, 1993).

*Primary Examiner*—James G. Smith
*Attorney, Agent, or Firm*—Harold A. Burdick

[57] ABSTRACT

A device for manipulating threaded connectors is disclosed, the device being particularly well suited for manipulating line fittings. The device includes a housing, a socket, a compact drive transfer assembly, and a mechanism for selectively locating the socket relative to the housing. The socket has a split side wall defining a gap and the housing has a gap at one part thereof, together to facilitate passage of the line into the socket for engagement of the fitting. The locating mechanism is actuatable by a user of the device to achieve correspondence of the gaps for engagement and/or disengagement of the device from the line.

18 Claims, 9 Drawing Sheets

MECHANISM FOR LOCATING A SLOTTED SOCKET RELATIVE TO A DRIVE TRANSFER HOUSING AND COMBINATION THEREOF

This is a continuation-in-part of Ser. No. 276,506, filed Jul. 18, 1994, now U.S. Pat. No. 5,460,062, which is a continuation of Ser. No. 025,949, filed Mar. 3, 1993, now abandoned.

FIELD OF THE INVENTION

This invention relates to socket drivers, and, more particularly, relates to such drivers for slotted sockets.

BACKGROUND OF THE INVENTION

While many devices for manipulating threaded connectors and driving slotted sockets have been heretofore known and/or utilized, a problem persists in their application and use when the connector to be manipulated is located in a cramped, distant or awkward to reach space, or is out of the line of sight. This has been particularly true where the threaded connector being manipulated is a line fitting (various types of which are utilized to join the ends of conduits, cables, and the like to each other or to another component in a mechanical and/or electrical system). Application and use of such heretofore known devices frequently has involved at least partial disassembly of associated structure or components to gain access to the line fitting, risked damage to the fitting, and/or required awkward manual manipulation (i.e., rotation) of the socket and/or driver to position the device over the line to engage the fitting. As may be appreciated, such difficulties slow operations, particularly critical, for example, in factory settings.

Perhaps the most common of such heretofore known devices are simple box wrenches or fitting wrenches. However, use of such standard wrenches, involving movement of the handle of the wrench through a significant arc, is not well suited to applications in cramped locations, or where a plurality of line fittings are closely positioned relative to one another (at least where one does not wish to remove all fittings in a series, or row, of fittings leading to the targeted fitting). Additionally, use of these well known types of wrenches necessarily involves a "hands-on" operation.

Various tools have been suggested to reach fasteners located in cramped areas and/or for application with a power driver (see, for example,. U.S. Pat. Nos. 3,477,318, 3,620,105, 2,578,686, 4,374,479, 4,928,559, 5,050,463 and 2,630,731), with such devices, however, likewise not providing for minimization of awkward manual manipulations of the tool and/or the socket during operation, and/or not optimizing ease of utility, mechanical durability and thus reliability, and compactness of structure. Further improvements in such tools could thus still be utilized.

SUMMARY OF THE INVENTION

This invention provides an improved device for manipulating threaded connectors, for example a line fitting while such fitting is in place on the line, with a split, or slotted, socket, and further provides a mechanism for locating the split socket relative to a drive transfer assembly housing.

The device of this invention includes a socket rotatably mounted in a compact drive transfer housing having a gap at one part thereof adjacent to the socket. A driver is releasably engagable with the drive transfer assembly located in the housing. The mechanism of this invention for selectively locating the socket relative to the housing is associated with the drive transfer assembly and allows a user to selectively bring the gap in the housing and the gap (i.e., the slot) in the socket into correspondence.

The device is thus configured to minimize the necessity for awkward manipulation of the socket, the device, the connector or the surrounding equipment or structure to achieve positioning or disengagement of the socket on the connector.

More particularly, the locating mechanism includes a rotatable means at the drive transfer assembly housing for transmitting rotary motion to the slotted socket and having an engageable structure associated therewith, and a locating means associated with the engageable structure of the rotatable means for selectively controlling rotation of the rotatable means when a user manipulates the locating means.

A first embodiment of the invention includes a manually rotatable member accessible to the user at the exterior of the drive transfer housing. A preferred embodiment of the invention provides a totally hands free operation, at least after user selection of function where provided, the locating means in such case including a switch and an engaging member selectively movable into and out of engagement with the engageable structure of the rotatable means by manipulation of the switch.

The preferred embodiment of the locating mechanism of this invention includes a shoulder extending axially away from and rotatable with a first gear of the drive transfer assembly, the shoulder having at least a first engageable portion configured at a selected position thereat. A first engaging member is positioned at the housing to contact the shoulder at the first engageable portion, the first engageable portion and the first engaging member being configured to resist engagement when in contact while the first gear and the shoulder are rotating to transmit rotary motion to the socket in a first direction and to engage when the first gear and the shoulder are rotated to transmit rotary motion to the socket in a second direction thus allowing free rotation of the socket in the first direction and stopping rotation of the socket in the second direction with the socket at a selected position.

The locating mechanism may further provide a second engageable portion configured at a selected position at the shoulder and a second engaging member positioned at the housing to contact the shoulder at the second engageable portion, the second engageable portion and the second engaging member being configured to allow free rotation of the socket in the second direction and stop rotation of the socket in the first direction with the socket at the selected position. A switch is provided for selectively (and independently) moving the engaging members into and out of contact with the engagable portions of the shoulder of the gear.

The device of this invention for manipulating a threaded line fitting while the fitting is in place around a line includes a socket having an inner periphery and an engageable outer periphery together defining a part of a side wall, the side wall having a gap therein to allow positioning of the socket around the line by passage of the line through the gap. A drive transfer assembly is provided including a housing having the socket rotatably mounted therein, the housing having a gap at one part thereof, and drive means mounted in the housing for imparting rotational motion to the socket and having a portion configured to be releasably engaged with a power driver, the gaps being in register when the socket is rotated to a selected position. A locating mechanism is positioned at the housing for providing user control of rotation of the socket to the selected position.

It is therefore an object of this invention to provide an improved device for manipulating threaded connectors.

It is another object of this invention to provide a device for manipulating threaded line fittings which includes a mechanism configured to minimize or avoid the necessity for awkward manual manipulations to achieve positioning of the device on the fitting.

It is another object of this invention to provide, in association with a drive transfer assembly having a housing and utilized to drive a slotted socket, a locating mechanism for locating the slotted socket at a selected position relative to the drive transfer assembly housing which includes a rotatable means at the drive transfer assembly housing for transmitting rotary motion to the slotted socket and having an engageable structure associated therewith, and a position selecting means associated with said engageable structure of said rotatable means for selectively controlling rotation of said rotatable means to facilitate selective location of the slotted socket relative to the drive transfer assembly housing when a user manipulates the position selection means.

It is still another object of this invention to provide a mechanism for locating a normally power driven slotted socket which includes a manually rotatable member accessible to a user at the exterior of a socket drive transfer assembly housing.

It is still another object of this invention to provide a locating mechanism for a slotted socket used with a drive assembly which includes a switch and an engaging member selectively movable into and out of engagement with an engageable structure of a rotatable means at the drive assembly by manipulation of said switch.

It is yet another object of this invention to provide a compact device for manipulating a threaded line fitting while the fitting is in place around a line, the device for releasable engagement with a power driver, the device including a socket having an inner periphery and an engageable outer periphery together defining a part of a side wall, the side wall having a gap therein to allow positioning of the socket around the line by passage of the line through the gap, a drive transfer assembly including a housing having the socket rotatably mounted therein, the housing having a gap at one part thereof, and drive means mounted in the housing for imparting rotational motion to the socket and having a portion configured to be releasably engaged with the driver, the gaps being in register when the socket is rotated to a selected position, and locating means at the housing for providing user control of rotation of the socket to the selected position.

It is yet another object of this invention to provide, in association with a drive transfer assembly having a housing and at least a first gear rotatable to transmit rotary motion in either of first and second directions to a slotted socket positionable at the housing, a locating mechanism for locating the slotted socket at a selected position relative to the drive transfer assembly housing including a shoulder extending axially away from and rotatable with the first gear, the shoulder having at least a first engageable portion configured at a selected position thereat, and a first engaging member positioned at the housing to contact the shoulder at the first engageable portion, the first engageable portion and the first engaging member being configured to resist engagement when in contact while the first gear and the shoulder are rotating to transmit rotary motion to the socket in the first direction and to engage when the first gear and the shoulder are rotated to transmit rotary motion to the socket in the second direction thus allowing free rotation of the socket in the first direction and stopping rotation of the socket in the second direction with the socket at the selected position.

It is yet another object of this invention to provide, in association with a drive transfer assembly having a housing and at least a first gear rotatable to transmit rotary motion in either of first and second directions to a slotted socket positionable at the housing, a locating mechanism for locating the slotted socket at a selected position relative to the drive transfer assembly housing irrespective of the direction of rotation of the socket and including engagable portions configured at selected positions at a shoulder of the first gear, and engaging members positioned at the housing to contact the shoulder at different ones of the engageable portions.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof and in which:

FIGS. 1 through 4A and 4B illustrate a first embodiment 15 of a device and locating mechanism in accord with this invention. Device 15 is shown in FIG. 1 in use to manipulate line fitting 17 around line segment 19 into engagement or disengagement with matable fitting 21 around line segment 23. Device 15 is releasably engaged with power driver 25 using flexible shaft 27 (though direct power driver engagement could be provided as shown hereinafter).

Turning to FIGS. 2, 3 and 4, device 15 includes socket 30 and drive transfer assembly 31. Drive transfer assembly 31 includes housing 33, formed by main housing body 35 and cover section 37, and gear train 38 including main drive gear 40 and linkage gears 42 and 44 for imparting rotational motion to socket 30 when driven by driver 25. Housing body 35 has indented structure 39 formed therein and openings 41, 43, 45 and 47 through rear wall 49 for housing socket 30 and drive transfer assembly 31. Cover section 37 includes openings 53, 55, 57 and 59, the corresponding openings in body 35 and cover section 37 receiving arcuate shoulders 60, 60', 62 62', 64, 64', and 66, 66' (66' not shown but being substantially the same as 64') of socket 30 and gears 40, 42 and 44, respectively, thus eliminating any need for axles, shafts, bearings and the like.

Figure 1:
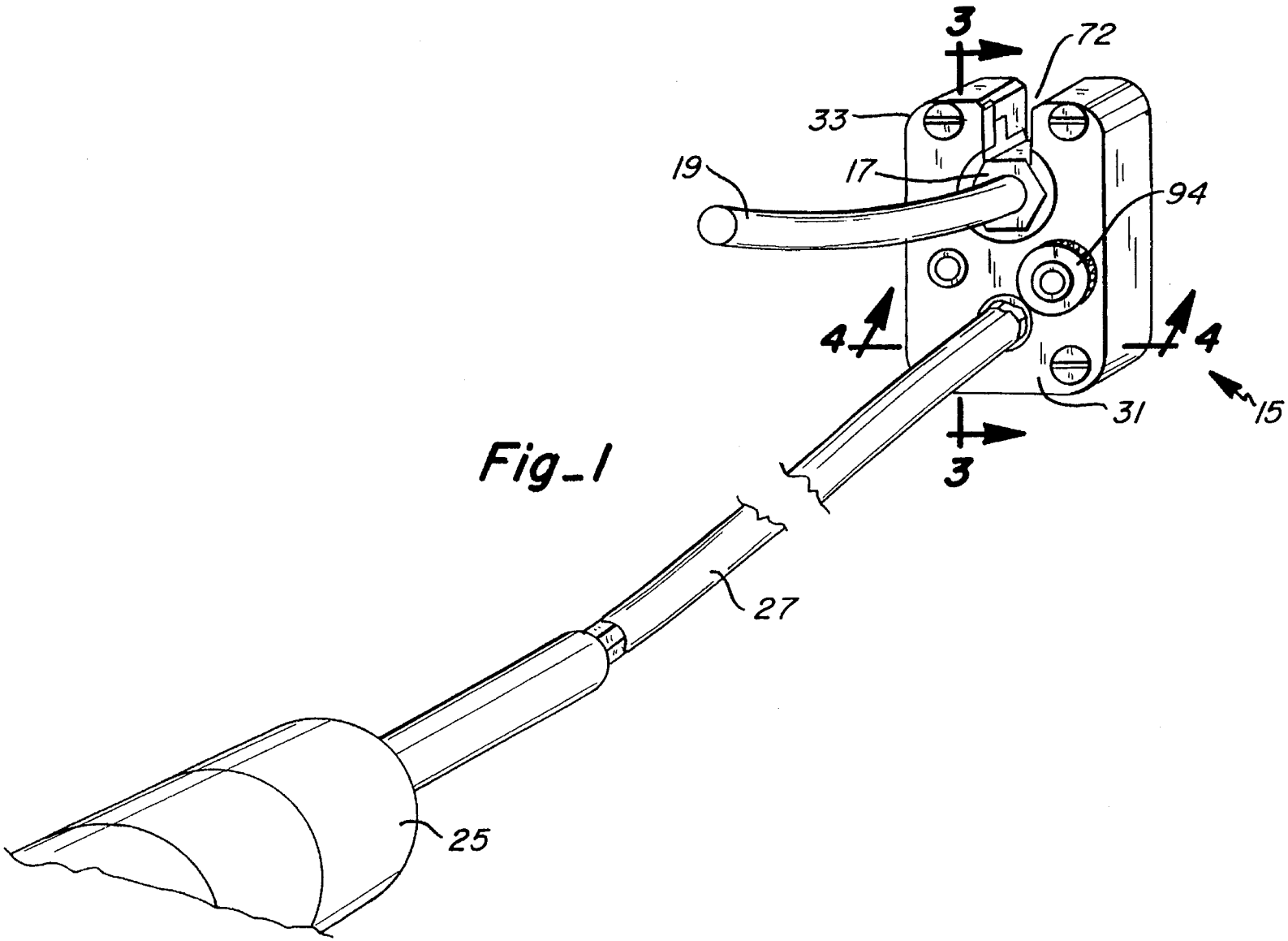
FIG. 1 is a perspective view of a first embodiment of the device and mechanism of this invention.
Figure 2:
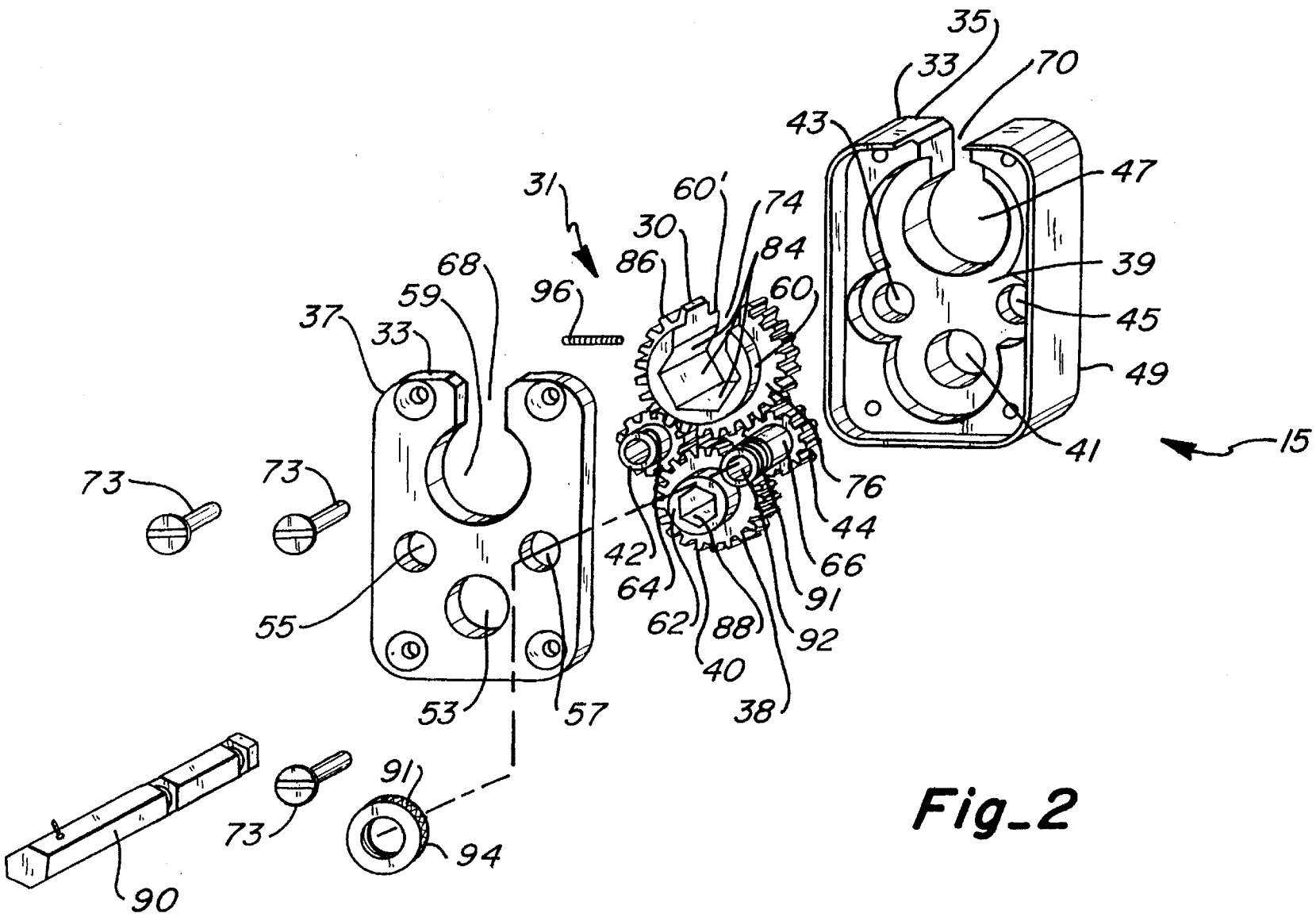
FIG. 2 is an-exploded view of the device and mechanism of FIG. 1.
Figure 3:
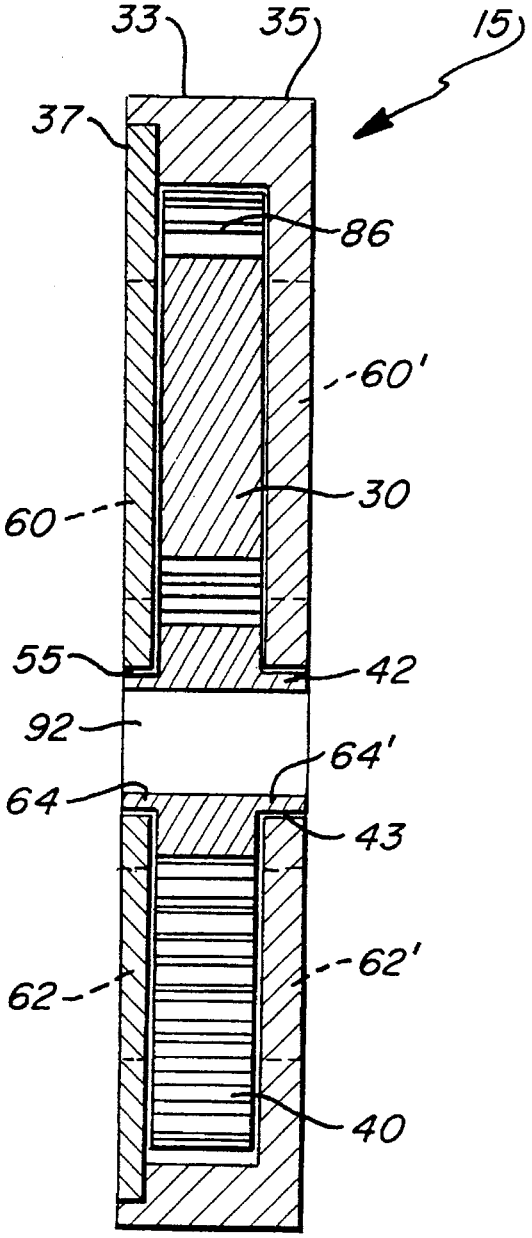
FIG. 3 is a sectional view taken through section line 3—3 of FIG.

Both cover section 37 and main body 35 include gaps 68 and 70, respectively extending from openings 59 and 47, respectively, the thus formed gap 72 in housing 33 (when assembled, utilizing, for example, machine screws 73, only 3 of which are shown in FIG. 2) corresponding in size to gap 74 formed in side wall 76 of socket 30 between spaced edges 78 and 80 thereof. Side wall 76 is defined between inner periphery 82 (which may be variously configured for receiving the connector to be manipulated, a hex fitting configuration with a plurality of facets 84 being illustrated herein) and the outer periphery of the socket which includes engagable outer periphery 86 as well as the outer periphery of shoulders 60 and 60'.

Drive gear 40 includes power driver attachment opening 88 for receipt of a rotatable shaft (such as flex shaft 27 or rigid shaft 90). Gear 40 and socket 30 are preferably of a size relative to one another to provide gear reduction (for example, about a 20% reduction). The housing, socket and gears are preferably formed of metals, though various plastics could be utilized in some applications for some of the parts of the device.

A first embodiment 91 of the locating mechanism of this invention is shown in FIG. 2. Linkage gear 44 includes elongated shoulder 92 extending through opening 57 of cover section 37, the shoulder being threaded at its outer terminus. Thumb wheel 94 is engageable at the threaded terminus of shoulder 92 and provides for accessible selective manual rotation thereof by a user to selectively position socket 30 relative to housing 33, for example to bring gaps 74 and 72 into register for engagement and/or disengagement of socket 30 and device 15 over line 19. This mechanism thus obviates any need for awkward direct manual manipulation of socket 30 and/or drive gear 40 to locate the socket and achieve correspondence of positions of the gaps.

While various sizes of device 15 are employed depending upon the size of connector involved, all are compact relative to the task, compactness, as well as durability, being achieved because of the particular relationship of gap size and gear sizes and/or placement of gears. In one particularly useful embodiment of the device, overall measurements of the device are less than about 4 cm (3.2 cm) by 6 cm (5 cm) by 1.5 cm (0.9 cm) with a gap size of about 0.8 cm. This embodiment is utilized, for example, with a 1 cm hex nut, thus providing a gap which is no more than about 75% the size of the fitting. In this manner, once the line is passed through the gap and the fitting is engaged, no non-rotational movement of the socket relative to the fitting in directions normal to the axis of rotation of the fitting can occur, sufficient facets 84 being provided to hold the fitting and socket in engagement. Thus, the likelihood of damage to and/or disengagement from the fitting is reduced during operation of the device.

Moreover, by reducing the size of the gap, linkage gears 42 and 44 can be more closely spaced while still retaining, and in fact improving, sufficient engagement with outer periphery 86 of socket 30 (two cogs being engaged by each linkage gear except during passage of gap 74, assuring a minimum of two cog engagement at all times) thereby diminishing the likelihood of damage to the gears and thus failure of the device. This may be achieved with linkage gear spacing at their nearest point substantially equal to gap size.

For example, utilizing the embodiment above discussed, the linkage gears can be positioned with the angle defined by lines extending between the axis of rotation of the socket and the axes of rotation of each of the linkage gears at about 73.66°. With about a 0.8 cm gap, the angle defined by lines extending between the axis of rotation of the socket and each of the edges of the side wall is about 48° (a ratio of about 1.5 to 1).

Figure 4A:
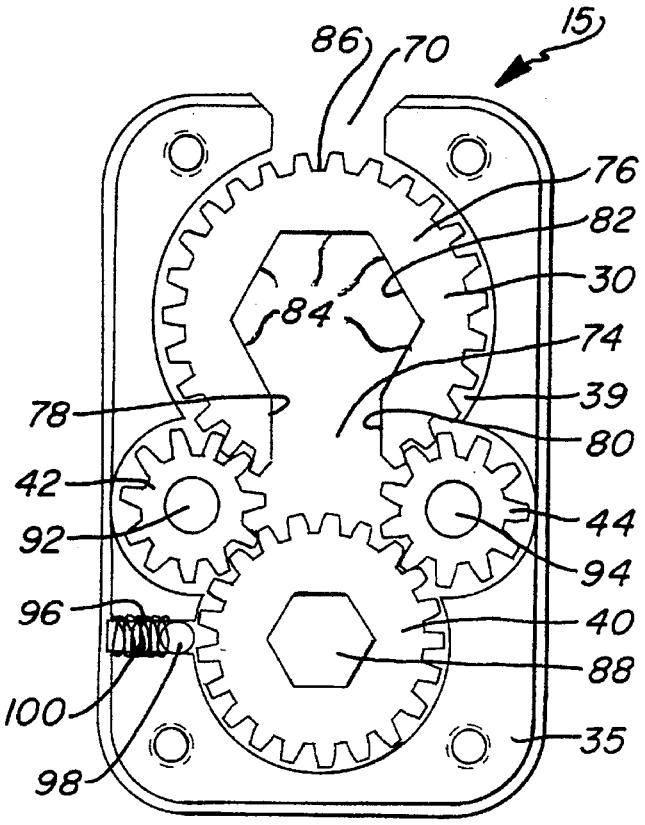
FIGS. 4A and 4B are sectional views taken through section line 4—4 of FIG. 1.
Figure 4B:
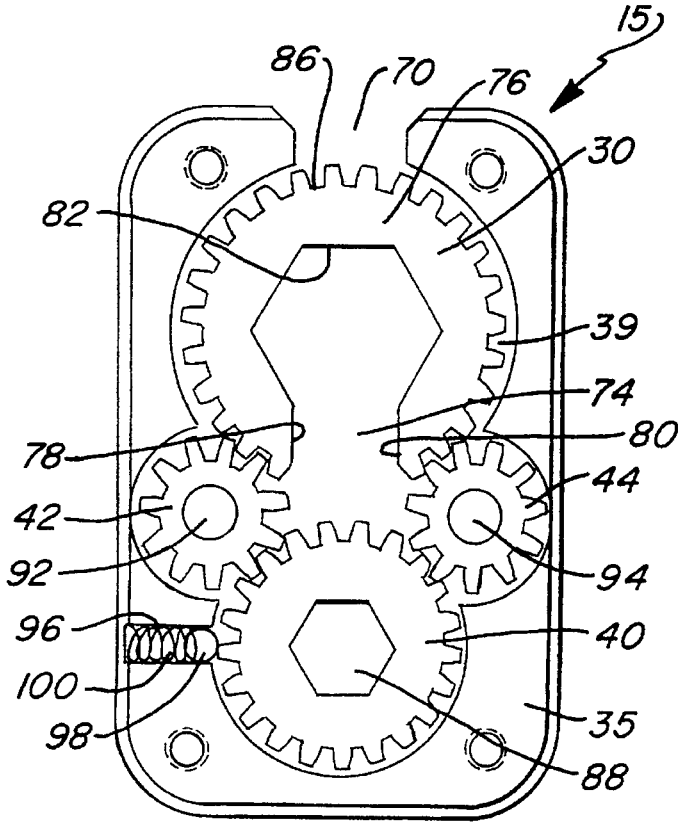
Figure 6:
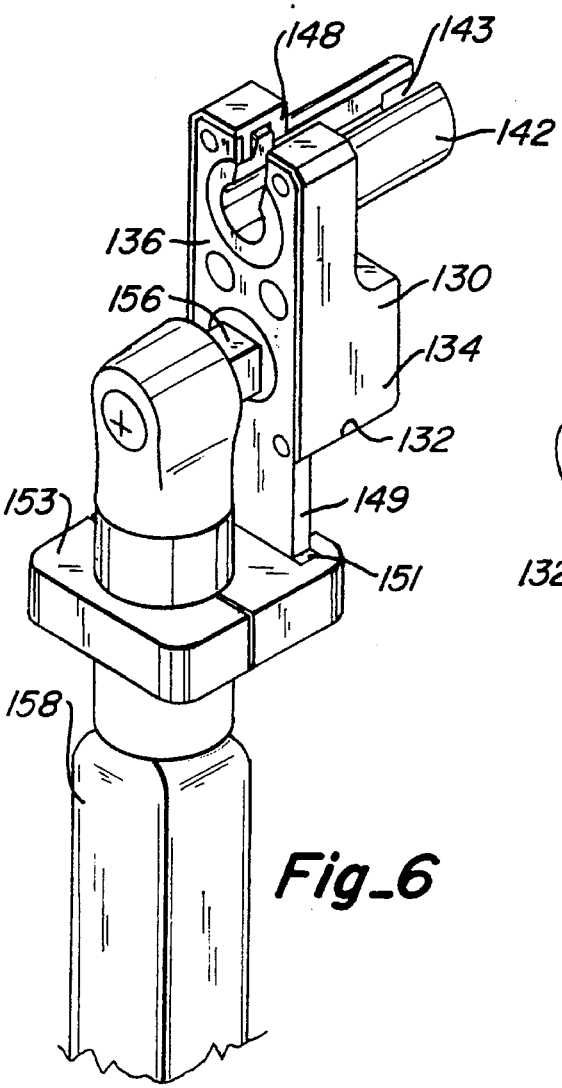
FIG. 6 is a perspective view of the preferred embodiment of the device having the mechanism therein of this invention.
Figure 7:
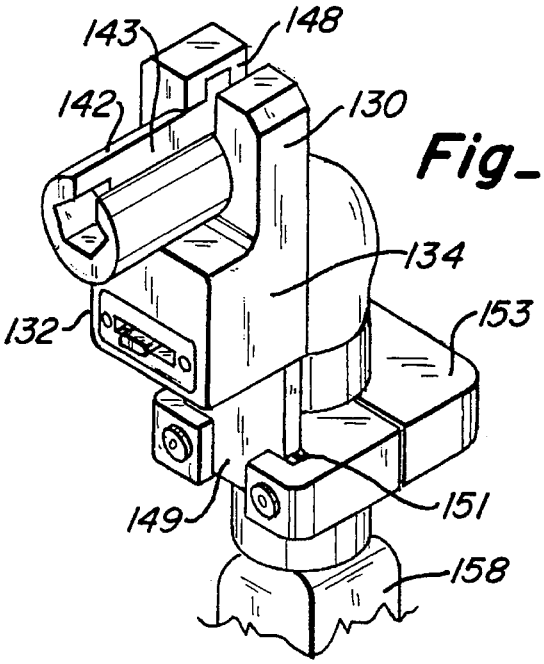
FIG. 7 is a reverse perspective view of the device of FIG. 6.
Figure 9:
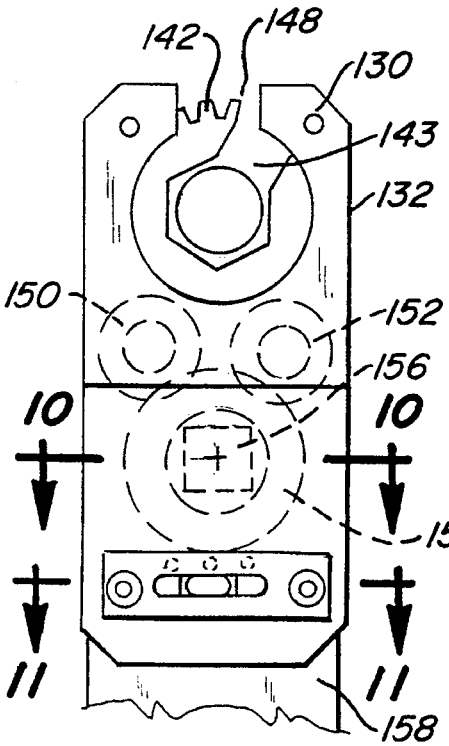
FIG. 9 is a front plan view of the device of FIG. 6.
Figure 8:
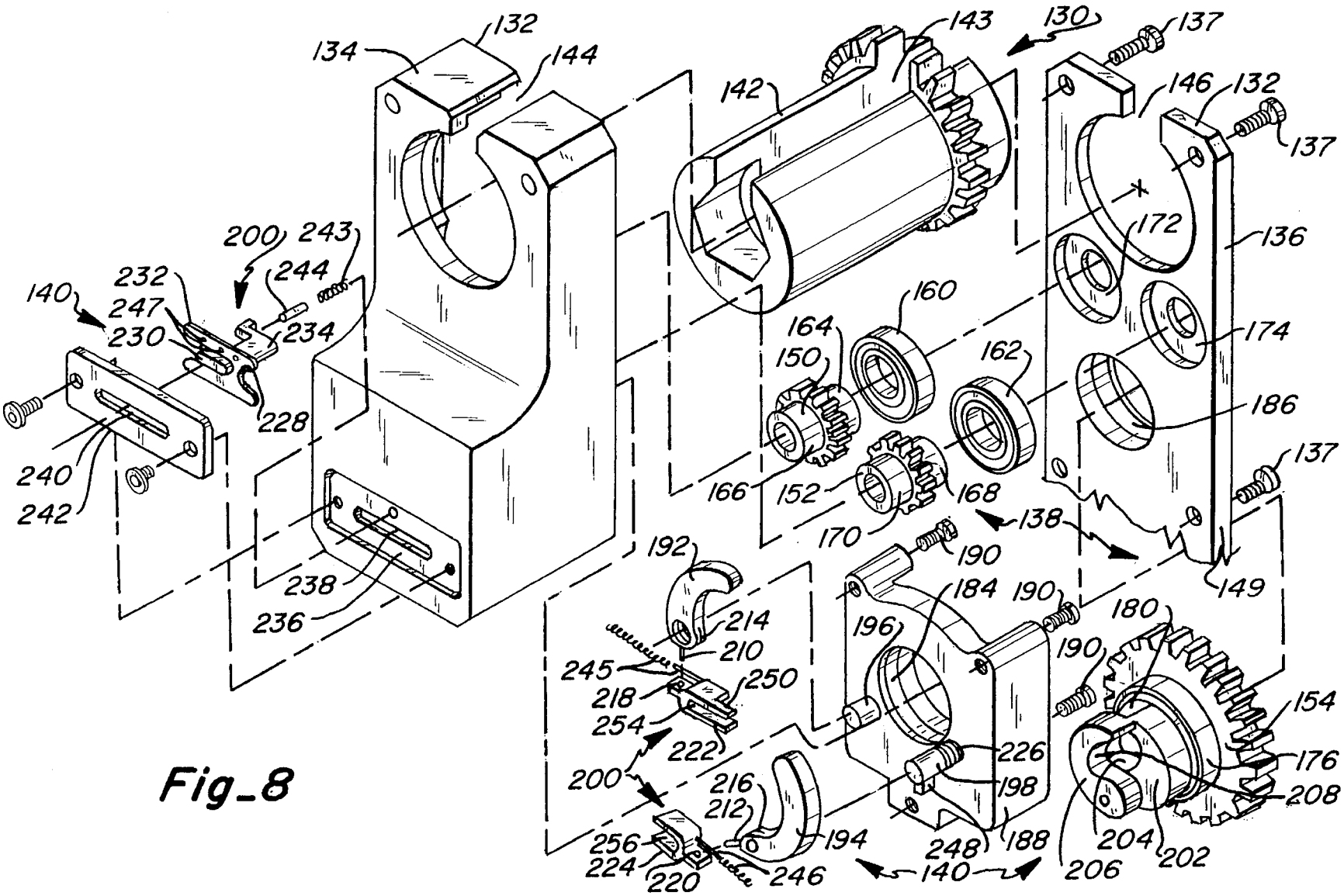
FIG. 8 is an exploded view of the device and mechanism of FIG. 6.
Figure 10:
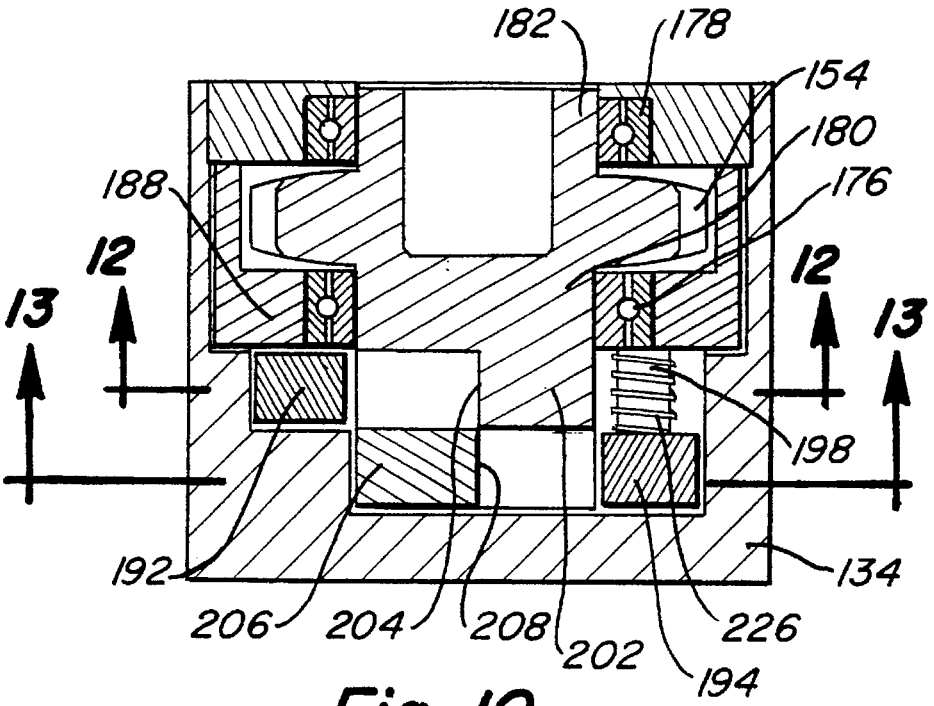
FIG. 10 is a sectional view taken through section lines 10—10 of FIG. 9.
Figure 11:
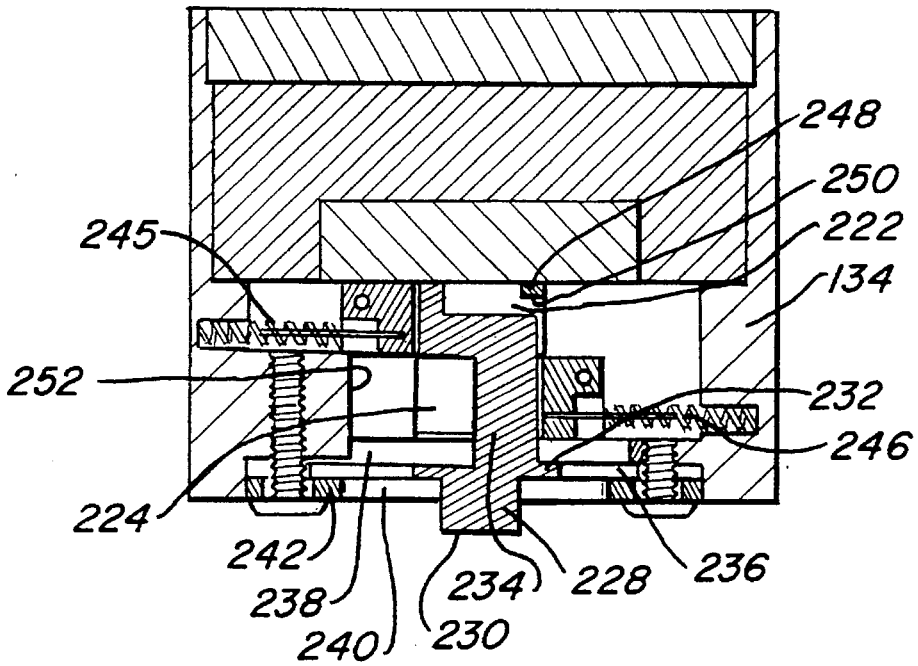
FIG. 11 is a sectional view taken through section lines 11—11 of FIG. 9.

In accord with another aspect of this invention, means for inhibiting rotation of the socket relative to the housing when power or other motive force is not being applied to the device is provided to allow for placement of the socket on the connector without free rotation thus allowing greater ease of use. Threaded ball plunger 96 is threaded into housing body 35 and includes, as is well known, ball 98 biased by spring 100. Since ball 98 is biased into engagement with gear 40 (the ball plunger could be applied to any of the gears or the socket), without power applied to rotate the gear, the gear, and thus the socket will be held in place (FIG. 4A), while application of rotary power from the driver will overcome the bias thereby allowing intended rotation of the socket (FIG. 4B).

Figure 5A:
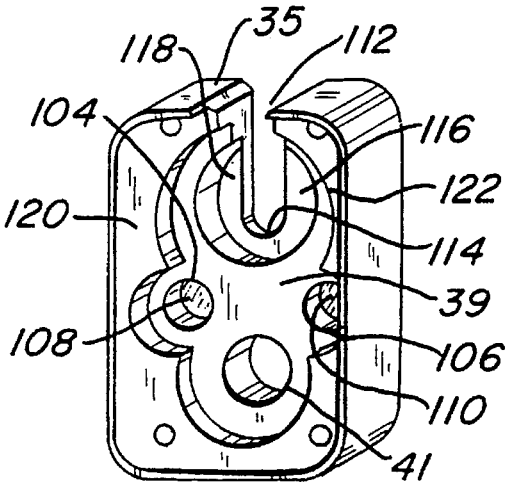
FIGS. 5A and 5B are perspective views of alternative housing designs for compact threaded connector manipulating devices, including the device of FIG. 1.

FIG. 5A shows an alternative design for main body 35 of housing 33 which is usable with threaded connector manipulating devices as heretofore described (and whether or not a locating mechanism of this invention is utilized with the device). Many features of main body 35 remain the same, including indented structure 39 and opening 41. However, instead of openings for gears 42 and 44, cavities 104 and 106 are provided which are closed at ends 108 and 110, respectively. In addition, line opening 112 has a dimension approximately the size of gap 70 (FIG. 2) to its terminus at end 114. Webbed pocket 116 is thus provided having back wall 118. Together, increased housing strength against flexure at shoulders 120 and 122 under applied torque (about 100% greater than the other design shown herein) and/or the ability to construct the housing of less expensive materials is provided by this alternative design. Moreover, wall 118 provides a positive stop for fasteners received through socket 30, thus assuring proper alignment of the fastener therein.

Figure 5B:
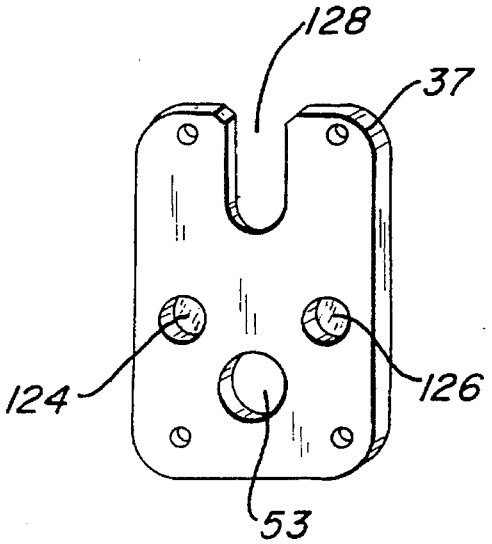

FIG. 5B illustrates an alternative design for cover section 37, again with many similarities to that heretofore described. Again, cavities 124 and 126 may be provided for linkage gears 42 and 44 rather than openings and line opening 128 is narrowed to provide increased strength and a positive stop (it should be noted, of course, that only one or the other, and not both, of openings 112 and 128 of housing body 33 and cover 37 can be narrowed in this fashion).

The now preferred embodiment 130 of this invention is illustrated in FIGS. 6 through 14A and 14B. Device 130 for manipulating threaded line fittings includes housing 132, defined by main body 134 and cover section 136 connected by connectors 137, for housing drive transfer assembly 138, locating mechanism 140 and split socket 142 having line opening gap 143 (it should be noted that the alternative housing design illustrated in FIG. 5A or FIG. 5B could be employed in housing 132, particularly where a socket as illustrated in FIG. 2 is utilized). Body 134 and cover section 136, as before, have gaps 144 and 146 thereat together forming line opening, or gap, 148 in housing 132.

Cover section 136 of housing 132 includes extended portion 149 (and main body 134 is appropriately machined to accommodate portion 149) receivable in slot 151 of stabilizer mount 153 in turn attached to power drive 158. In this manner, rotation of the entire device 130 is resisted when shaft 156 is rotating.

As before, drive transfer assembly 138 includes linkage gears 150 and 152 and main drive gear 154 (cooperative operation of the gears and socket 142 is the same as heretofore described). Drive gear 154 is configured to receive rotatable shaft 156 of power driver 158 as heretofore described. Linkage gears 150 and 152 are mounted on bearings 160 (two of, only one of which is illustrated in FIG. 2) and bearings 162 (again only one of which is illustrated in FIG. 2), respectively, received over shoulders 164 and 166 of linkage gear 150 and shoulders 168 and 170 of linkage gear 152, respectively. The bearings are in turn received in indentions 172 and 174 of cover section 136 and like indentions in main body 134.

Drive gear 154 is mounted on bearings 176 and 178 (FIG. 10) on elongated shoulder 180 (extending axially away from and rotatable with drive gear 154) and shoulder 182, respectively, in indentions 184 and 186 of bearing block 188 and cover section 136, respectively. Bearing block 188 is connected to main body 134 by connectors 190.

Locating mechanism 140 includes extended shoulder 180 and at least one of engaging members 192 and 194 mounted on shafts 196 and 198, respectively, formed or secured in bearing block 198. In many applications, switching assembly 200 will be required (as is true of the embodiment illustrated).

Elongated shoulder 180 (preferably monolithically milled with drive gear 154) extends outward along the axis of gear 154 and is in the nature of a short shaft. A first milled structure 202 having an s-curved engageable face 204 is established at a position selected to be adjacent to bearing 176 and a second milled structure 206 having an s-curved engageable face 208 is established at the end of shoulder 180. The s-curved faces 204 and 208 are situated directly opposite one another on shoulder 180. While other configurations of structures 202 and 206 and engaging members 192 and 194 could be utilized, those illustrated are currently preferred, and proper positioning of the s-curved faces as illustrated herein is required for precision operation.

Engaging members 192 and 194 are configured with an arcuate inner surface having a similar degree of arc as shoulder 180, and include torsion springs 210 and 212 in slots 214 and 216. Each spring configured to spiral around shafts 196 and 198, respectively, and one end of each of which is held immobile in its respective engaging member. The other end of each spring 210 and 212 is received in openings 218 and 220, respectively, of actuation guides 222 and 224 of switching assembly 200. When mounted, engaging member 192 is located in an indention in main body 134 of housing 132 and member 194 is maintained between spacer coil 226 and main body 134 (see FIG. 10).

Figure 12:
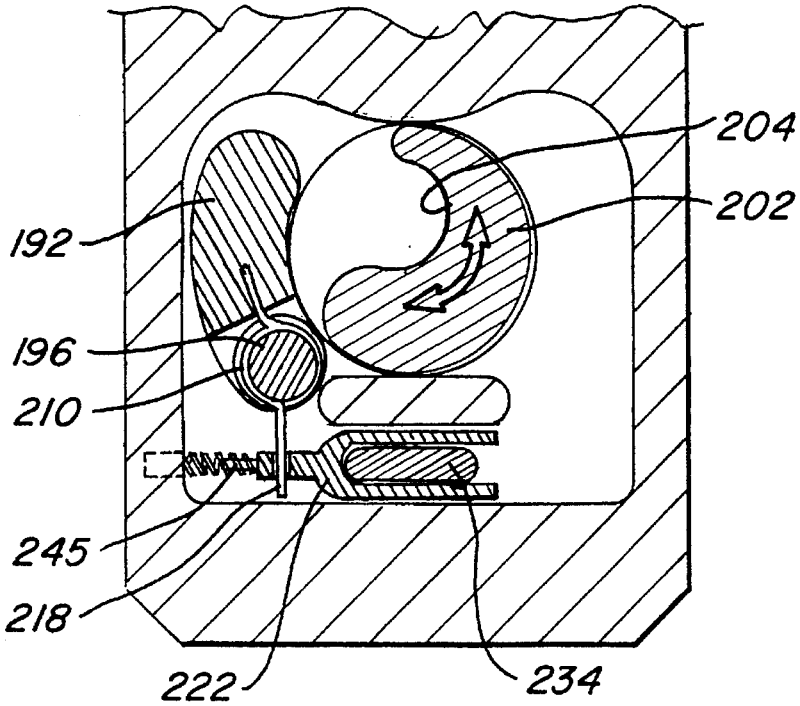
FIG. 12 is a sectional view taken through section lines 12—12 of FIG. 10.
Figure 13:
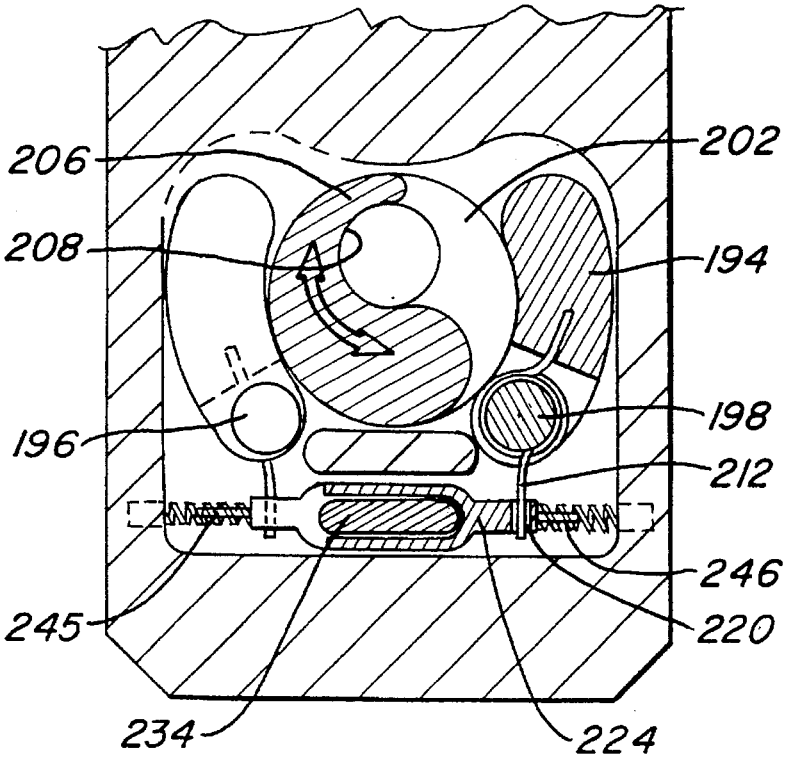
FIG. 13 is a sectional view taken through section lines 13—13 of FIG. 10.

Switching assembly 200 further includes actuator 228 having externally accessible operator 230, sliding guide 232 and mounting bar 234 over which actuating guides 222 and 224 are maintained (see FIGS. 12 and 13). Actuator 228 is mounted in indention 236 of main body 134 of housing 132 with bar 234 extending through slot 238 and operator 230 extending through slot 240 in cover plate 242 attached to the main body so that sliding guide 232 is movable laterally in indention 236. Spring 243 biases pin 244 into detents 247 to indicate and assure relevant switch positioning.

Actuating guides 222 and 224 are biased toward the neutral position (i.e., with neither engaging member 192 or 194 in contact with shoulder 180 as shown in FIG. 13) and into engagement with bar 234 by pin and spring assemblies 245 and 246. Positive stop 248 is engageable at notch 250 of guide 222 when the guide is moved into contact therewith, guide 224 having a positive stop provided by wall 252 in main body 134 of housing 132.

Figure 14A:
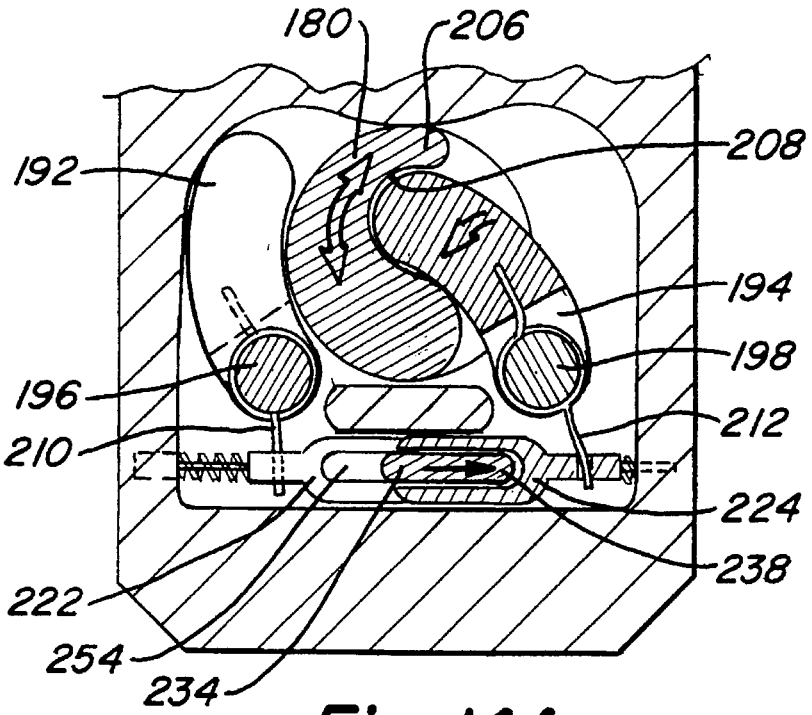
FIGS. 14A and 14B are sectional views illustrating operation of the mechanism of the invention.
Figure 14B:
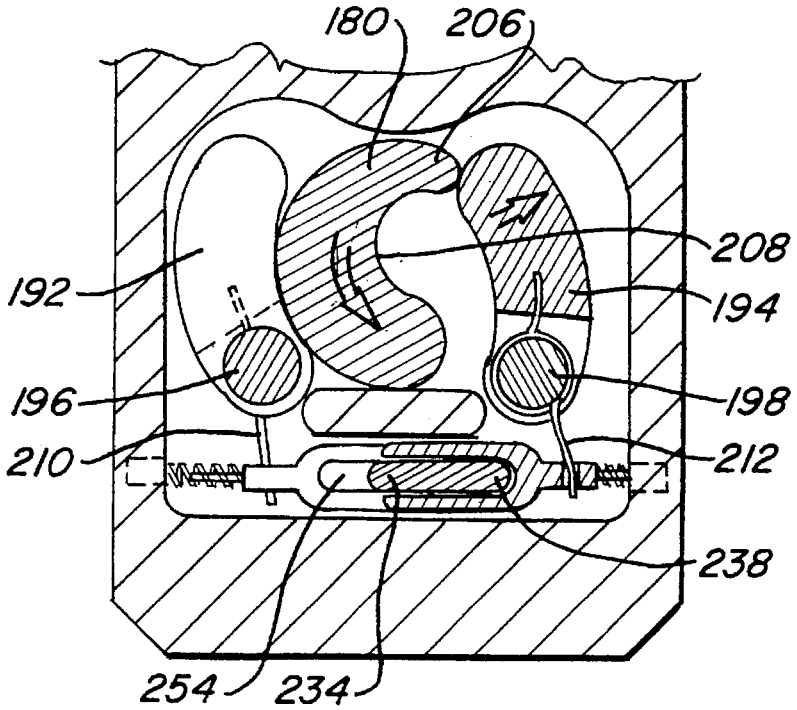

Operation of the device and mechanism of this invention is illustrated in FIGS. 14A and 14B. When switching assembly 238 is actuated by a user from the neutral position (i.e., from the central position of operator 230) and shifted to the right in FIGS. 14A and 14B, guide 224 is also moved to the right carrying with it the end of torsion spring 212 thus biasing engaging member 194 into contact with shoulder 180 at milled structure 206. Guide 222 does not move as bar 234 slides along guide slot 254. When power is applied to device 130 by driver 158 to cause rotation in the clockwise direction in the FIGURES, s-curved face 208 of structure 206 and engaging member 194 are soon (within one revolution) engaged (FIG. 14A) and rotation of shoulder 180, and thus drive gear 154, is stopped by member 194 thereby locating the socket at the selected position (i.e., with the gaps in the housing and in the socket in correspondence).

When rotation is caused in the counter-clockwise direction in the FIGURES the arcuate face of member 194 and the s-curved face of structure 206 slide by one another (FIGS. 14A and 14B), member 194 remaining in contact with shoulder 180 but without engaging structure 206 thus allowing continued rotation of the socket.

Member 192 is actuated in a like manner by movement of bar 234 and thus actuating guide 222 to the left of center thus biasing member 192 into contact with shoulder 180 and structure 202 while guide 224 does not move as bar 234 slides along guide slot 256. In this manner, counterclockwise motion of shoulder 180, and thus gear 154 and socket 142, is halted within one revolution by engagement of member 192 at s-curved face 204 of structure 202, while clockwise rotation is not inhibited. Again the socket, when stopped by the locating means of this invention, is located at the selected position with the gaps in the housing and in the socket in correspondence.

As may be appreciated, at the time of assembly of the socket in the housing, it is important to first engage one of the members 192 or 194 at its corresponding s-curved face and then insert the socket so that the gaps in the socket and the housing are in correspondence to assure proper location of the socket by the mechanism of this invention during operation of the device.

Moreover, while the preferred embodiment shows the ability to locate the socket at the selected position without regard to the direction of rotation of the socket, where the device is used in single application utilizations (for example, repeatedly either only removing or applying a line fitting), only a single engaging member and corresponding s-curved engageable face at the elongated shoulder of the drive gear needs to be provided, thereby also eliminating any need for the switching assembly shown herein.

What is claimed is:

1. In association with a drive transfer assembly having a housing and engageable with a power driver together utilized to drive a slotted socket, a locating mechanism for locating the slotted socket at a selected position relative to the drive transfer assembly housing comprising:

rotatable means at the drive transfer assembly housing for transmitting rotary motion to the slotted socket and having an engageable structure including an s-curved face associated therewith; and position selection means including an engaging member having an arcuate face operably associated with said engageable structure of said rotatable means for selectively controlling rotation of said rotatable means to facilitate selective location of the slotted socket relative to the drive transfer assembly housing when a user manipulates said position selection means.

2. The mechanism of claim 1 wherein said position selection means is a manually rotatable member accessible to a user at the exterior of the housing and wherein said rotatable means is a gear, said engageable structure of said rotatable means including an elongated shoulder.

3. The mechanism of claim 1 wherein said position selection means includes a switch and an engaging member selectively movable into and out of engagement with said engageable structure of said rotatable means by manipulation of said switch.

4. The mechanism of claim 1 wherein said rotatable means is rotatable in either of first and second directions, and wherein said position selection means includes a user accessible operator and is operable to halt rotation of said rotatable means in a user selected one of either of said directions so that the socket is at the selected location by user manipulation of said operator.

5. The mechanism of claim 1 wherein said engageable structure includes a threaded shoulder portion, and wherein said position selection means includes a thumb wheel engaged at said threaded shoulder.

6. A compact device for manipulating a threaded line fitting while the fitting is in place around a line, said device for releasable engagement with a power driver, said device comprising:

a socket having an inner periphery and an engageable outer periphery together defining a part of a side wall, said side wall having a gap therein to allow positioning of said socket around the line by passage of the line through said gap;

a drive transfer assembly including a housing having said socket rotatably mounted therein, said housing having a gap at one part thereof, and drive means mounted in said housing for imparting rotational motion to said socket in either of first and second directions and having a portion configured to be releasably engaged with the driver, said gaps being in register when said socket is rotated to a selected position; and first locating means at said housing for selectively providing user control of rotation of said socket to said selected position when said drive means imparts rotational motion to said socket in said first direction but not in said second direction; and second locating means at said housing for selectively providing user control of rotation of said socket to said selected position when said drive means imparts rotational motion to said socket in said second direction but not in said first direction.

7. The device of claim 6 wherein said drive means includes a main drive gear engageable with the driver and first and second linkage gears both engaging said drive gear and said outer periphery of said socket, said first and second locating means being operatively associated with one of said gears.

8. The device of claim 7 wherein said one of said gears is one of said linkage gears.

9. The device of claim 7 wherein each of said locating means includes a first engaging member positioned at the housing and configured to halt rotation of said drive gear at said selected position.

10. The device of claim 9 wherein each of said locating means includes engageable structure at said drive gear.

11. The device of claim 10 wherein said engageable structure and said engaging member of each of said locating means are complimentarily configured so that rotation of said drive gear in a selected direction is not stopped even when one of said members and one of said structures are in contact.

12. The device of claim 6 wherein said drive means is a gear, and wherein said first and second locating means include a user accessible operator operable to halt rotation of said gear in a user selected one of either of said directions so that said socket is at said selected position by user manipulation of said operator.

13. In association with a drive transfer assembly having a housing and at least a first gear rotatable to transmit rotary motion in either of first and second directions to a slotted socket positionable at the housing, a locating mechanism for locating the slotted socket at a selected position relative to the drive transfer assembly housing comprising:

a shoulder extending axially away from and rotatable with said first gear, said shoulder having at least a first engageable portion configured at a selected position thereat; and a first engaging member including an arcuate face and mounted on a shaft adjacent one end thereof at the housing, said first engaging member biased into contact with said shoulder to contact said shoulder at said first engageable portion, said first engageable portion and said first engaging member being configured to resist engagement when in contact while the first gear and said shoulder are rotating to transmit rotary motion to the socket in the first direction and to engage when the first gear and said shoulder are rotated to transmit rotary motion to the socket in the second direction thus allowing free rotation of the socket in the first direction and stopping rotation of the socket in the second direction with said socket at the selected position.

14. The locating mechanism of claim 13 further comprising:

a second engageable portion configured at a selected position at said shoulder; and a second engaging member positioned at the housing to contact said shoulder at said second engageable portion, said second engageable portion and said second engaging member being configured to resist engagement when in contact while the first gear and said shoulder are rotating to transmit rotary motion to the socket in the second direction and to engage when the first gear and said shoulder are rotated to transmit rotary motion to the socket in the first direction thus allowing free rotation of the socket in the second direction and stopping rotation of the socket in the first direction with the socket at the selected position.

15. The locating mechanism of claim 14 further comprising switching means for selectively moving said engaging members into and out of contact with said engageable portions of said shoulder so that either no contact between said engaging members and said engageable portions occurs or contact between a user selected one of said engaging members and the corresponding one of said engageable portions occurs.

16. The locating mechanism of claim 13 wherein said engageable portion of said shoulder includes an s-curved face.

17. The locating mechanism of claim 16 further comprising a second engaging member operable independently of said first engaging member by a user of the device and being configured to allow free rotation of the socket in the second direction and stop rotation of the socket in the first direction with the socket at the selected position.

18. The locating mechanism of claim 13 wherein said shoulder and said engaging member are both located within the housing.

* * * * *